US005819667A

United States Patent [19]

Rodi

[11] Patent Number: 5,819,667

[45] Date of Patent: Oct. 13, 1998

[54] DIGITAL PRINTING MACHINE AND METHOD OF TRANSPORTING SHEETS THEREFOR

[76] Inventor: Anton Rodi, Karlsruher Strasse 12, D-69181 Leimen, Germany

[21] Appl. No.: 759,406

[22] Filed: Dec. 4, 1996

[30] Foreign Application Priority Data

Dec. 4, 1995 [DE] Germany ..... 195 45 113.9

[51] Int. Cl.[6] ..... B41F 1/34

[52] U.S. Cl. ..... 101/485; 101/486; 399/159

[58] Field of Search ..... 101/485, 486, 101/489, 212, 216, 232; 399/159, 312, 398, 395, 308

[56] References Cited

U.S. PATENT DOCUMENTS

| | | | |
|---|---|---|---|
| 3,880,076 | 4/1975 | Black et al. | 101/485 |
| 3,955,494 | 5/1976 | Suzuki | 101/232 |
| 4,297,022 | 10/1981 | Lester | 355/3 R |
| 4,511,242 | 4/1985 | Ashbee et al. | 399/395 |
| 4,688,931 | 8/1987 | Hermkens | 399/308 |
| 4,729,310 | 3/1988 | Love, III | 101/157 |
| 4,941,004 | 7/1990 | Pham et al. | 346/160 |
| 4,962,707 | 10/1990 | Claussen | 101/212 |
| 5,233,396 | 8/1993 | Simms et al. | 399/308 |
| 5,428,429 | 6/1995 | Fletcher | 399/308 |

FOREIGN PATENT DOCUMENTS

| | | |
|---|---|---|
| 0 058 182 B1 | 8/1982 | European Pat. Off. . |
| 0 264 507 A1 | 4/1988 | European Pat. Off. . |
| 283 450 | 2/1914 | Germany . |
| 465 246 | 9/1928 | Germany . |
| 1 611 251 | 3/1972 | Germany . |
| 35 34 801 A1 | 7/1986 | Germany . |
| 40 13 003 A1 | 10/1991 | Germany . |
| 42 19 116 C2 | 12/1993 | Germany . |
| 61-221026 | 10/1986 | Japan . |
| 1-274164 | 11/1989 | Japan . |

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

A digital printing machine including an endless conveyer belt having an elongated section whereon substrates to be printed are successively transported through the printing machine in a transport direction includes at least one printing unit having a cylinder arranged opposite the elongated section of the conveyer belt and the substrates conveyed thereon, respectively, the cylinder having an axis extending transversely to the transport direction and being rotatable in synchronism with the transporting movement of the conveyer belt, so as to transfer printing ink to the substrates in accordance with a distribution corresponding with a desired printing image, the cylinder being disposed so that an angle defined between the cylinder axis and the transport direction has a value differing from 90°.

9 Claims, 1 Drawing Sheet

DIGITAL PRINTING MACHINE AND METHOD OF TRANSPORTING SHEETS THEREFOR

BACKGROUND OF THE INVENTION

Field of the Invention

The invention relates to a digital printing machine and a method of transporting sheets therefor and, more particularly, transporting sheets past one or more digital printing units with an endless conveyor belt.

A digital printing machine is formed of one or more printing units with an imaging head controllable by electric signals for producing latent images corresponding with the electric signals on a movable intermediate carrier. The latent images may, for example, be charge distributions of electrons or ions on the intermediate carrier. The latent images are developed by an inking unit which applies printing ink to the intermediate carrier according to the charge distribution. Thereafter, the printing ink is transferred either directly from this intermediate carrier to the printing substrate, such as paper sheets, or indirectly via one or more further intermediate carriers.

Rotating cylinders or belts revolving around rotating cylinders are used as intermediate carriers. The sheets to be printed are conveyed past the intermediate carrier and past the last one of a plurality of intermediate carriers arranged in a row, respectively, the ink being transferred to the sheets, for example, through more or less heavy pressure.

For the transport of the sheets past the printing units, endless conveyor belts have been provided which have an elongated section for transporting the sheets from a feeder pile to a delivery pile. The required transfer pressure can be applied, for example, by impression cylinders arranged on the side of the conveyor belt opposite the sheets, so that the conveyor belt and thereby the sheets are pressed against the intermediate carrier of the printing unit.

When a sheet exits from the nip between the conveyor belt and the intermediate carrier, the danger arises that the sheet may continue to adhere to the intermediate carrier and become separated from the conveyor belt. This must be prevented under all circumstances.

For this purpose, for example, a conveyor belt made of insulating material which is electrically charged may be used, so that the sheets may be kept adhered to the conveyor belt by means of electrostatic attracting forces. As has become apparent, relatively strong holding forces are needed, in order reliably to prevent separation of a sheet from the conveyor belt. To create these strong holding forces is not only costly but can also complicate the separation of the sheets from the conveyor belt, in order to deposit them on a delivery pile after they have passed the printing units.

SUMMARY OF THE INVENTION

It is accordingly an object of the invention of the instant application to provide a digital printing machine and a method of transporting sheets therefor with which the sheets are kept reliably adhered to the conveyor belt with weak holding forces acting upon the sheets as they pass an intermediate carrier from which the printing ink is transferred onto the sheets.

With the foregoing and other objects in view, there is provided, in accordance with one aspect of the invention, a digital printing machine including an endless conveyor belt having an elongated section whereon substrates to be printed are successively transported through the printing machine in a transport direction, and comprising at least one printing unit having a cylinder arranged opposite the elongated section of the conveyor belt and the substrates conveyed thereon, respectively, the cylinder having an axis extending transversely to the transport direction and being ratable in synchronism with the transporting movement of the conveyor belt, so as to transfer printing ink to the substrates in accordance with a distribution corresponding with a desired printing image, the cylinder being disposed so that an angle defined between the cylinder axis and the transport direction has a value differing from 90°.

In accordance with another feature of the invention, the printing ink to be transferred is located on a surface of either the cylinder or a belt revolving around the cylinder.

In accordance with a further feature of the invention, the digital printing machine includes an elongated imaging device arranged transversely to the transport direction alongside the surface of the cylinder or the belt revolving around the cylinder, the imaging device being controllable by electrical signals for producing latent images on the surface in accordance with the electrical signals, the printing unit including an inking unit for developing the latent images with printing ink.

In accordance with an added feature of the invention, the imaging device is disposed at an angle of 900 to the transport direction.

In accordance with an additional feature of the invention, the imaging device is disposed parallel to the axis of the cylinder.

In accordance with yet another feature of the invention, the digital printing machine includes a device for generating attracting forces between the conveyor belt and the substrates transported thereby.

In accordance with yet a further feature of the invention, the attracting forces are electrostatic forces.

In accordance with yet an added feature of the invention, the at least one printing unit has a plurality of cylinders arranged opposite the elongated section of the conveyor belt and the substrates conveyed thereon, respectively, each of the cylinders having an axis extending transversely to the transport direction and being ratable in synchronism with the transporting movement of the conveyor belt, so as to transfer printing ink to the substrates in accordance with a distribution corresponding with a desired printing image, the cylinders being disposed so that an angle defined between the respective cylinder axes thereof and the transport direction has a value differing from 90°.

In accordance with another aspect of the invention, there is provided a method for transporting substrates to be printed in a printing machine on an endless conveyor belt past at least one digital printing unit, which includes depositing the substrates on the conveyor belt in an orientation wherein an angle defined between a leading edge of the substrates and the transport direction of the conveyor belt intersecting therewith has a value differing from 90°.

In accordance with another mode, the method of the invention includes providing printing ink in the digital inking unit in accordance with a distribution corresponding with the desired printing images, and transferring the printing ink to the substrates, and thereby producing the printing images in an orientation corresponding with a skewed position of the substrates.

In accordance with a further mode, the method of the invention includes generating attracting forces between the conveyor belt and the substrates transported thereby.

In accordance with a concomitant mode, the method of the invention includes generating the attracting forces electrostatically.

According to the invention, entire leading edges of the sheets do not enter into the nip between a cylinder and the conveyor belt at once, as is generally conventional for printing machines, but rather, gradually, while they are in a skewed position with respect to the cylinder. Accordingly, along the width or breadth of the sheet, only a small section of the leading edge of the sheet always falls within a critical region which is in danger of separation. Consequently, the inherent stiffness of the sheets in combination with the interfacial adherence thereof to the conveyor belt may already be sufficient, in order for the sheets to leave the nip reliably without separating from the conveyor belt.

In support thereof, additional holding forces acting upon the conveyor belt may be used, advantageously cooperating with the manner of sheet entry into the nip in accordance with the invention. The regions of the sheet adjacent to the aforementioned critical region have altogether a much larger area than the region passing through the nip. Thus, the regions of the sheet which are not in the nip at the particular time enable the narrow section of the leading edge of the sheet passing through the nip to remain adhered to the conveyor belt, even if relatively weak holding forces are acting thereon.

The invention is especially suitable, in combination with electrostatic holding forces which can be produced in a very simple manner, but which become weaker in proportion to the distance between the sheet and the conveyor belt. Whereas, with sheet entry in the conventional manner, even a slight sheet separation from the conveyor belt cannot be reparable or corrected any more, thereby leading to a disruption in the printing operation, any partially occurring sheet separations may be undone through the adjacent regions by the manner of sheet entry according to the invention.

On the other hand, the invention is also effective in combination with supporting holding forces acting upon the conveyor belt, the forces being produced in a manner other than electrostatically, for example, through a weak underpressure.

The invention has the additional advantage that impacts or shocks, which usually occur when sheets enter into and exit from the nip, are avoided. This damping of the impacts or shocks is especially effective when the sheets are conveyed in close succession, so that a new sheet already enters the nip on the one side while the preceding sheet has not yet left the nip on the other side.

The invention can be realized in two alternative ways. Either the sheets are conveyed by a feeder in a conventional manner onto the conveyor belt, i.e., with the leading edge thereof precisely perpendicular to the transport direction, and the cylinders, whereon the transfer of the printing ink takes place, are arranged in a skewed position, or the cylinders are arranged in the conventional manner, namely perpendicularly to the transport direction, and the feeder is adapted to deposit the sheets on the conveyor belt in a desired skewed position.

In both cases, advantage is taken of the fact that digital printing machines have an imaging device for producing latent images on an intermediate carrier based upon image data. Either the image data are being changed or influenced to suit the skewed position of the sheets before the image data are transmitted to the imaging device, so that the image can be printed on the sheets undistorted and in correspondence with the original, or the imaging device is arranged so as to be in a skewed position with respect to the intermediate carrier which corresponds with the skewed position of the sheets.

Other features which are considered as characteristic for the invention are set forth in the appended claims.

Although the invention is illustrated and described herein as embodied in a digital printing machine and a method for transporting sheets therefor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
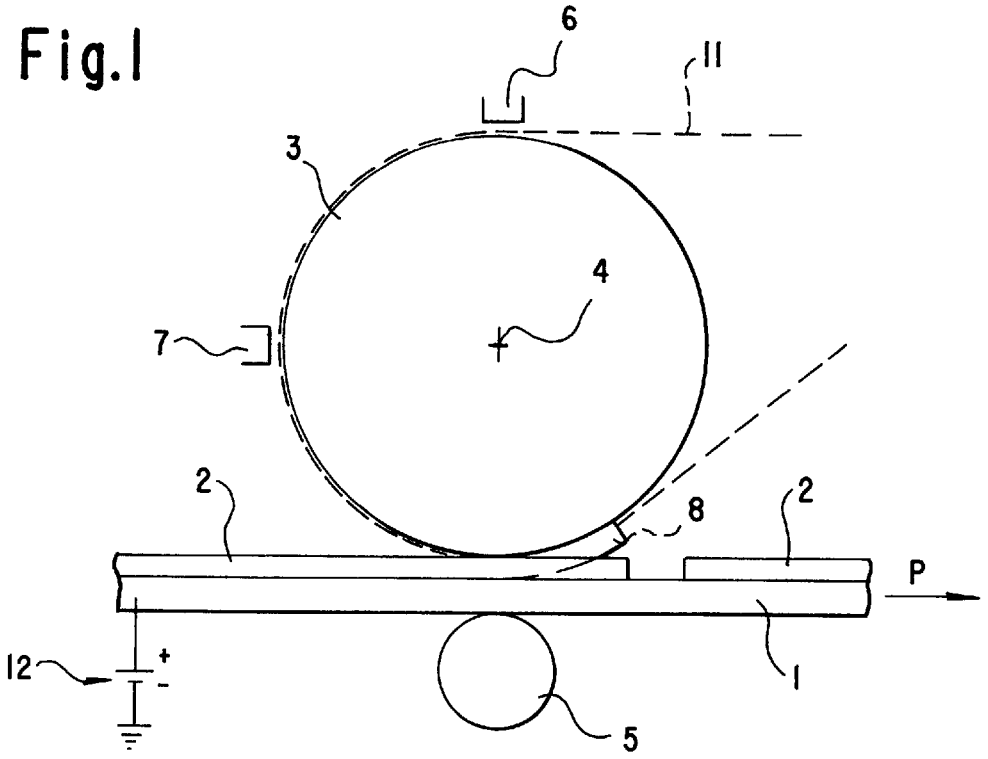
FIG. 1 is a diagrammatic fragmentary longitudinal sectional view of a digital printing machine according to the invention including one of the transfer cylinders thereof.

Referring now to the drawings and, first, particularly to FIG. 1 thereof, there is shown therein a digital printing machine having a conveyor belt 1 for conveying sheets 2 adhering to said conveyor belt 1 in a direction represented by an arrow P from a feeder pile to a delivery pile, both of which are not illustrated in the drawings. The sheets 2 may be paper sheets or any other substrates to be printed, such as synthetic foils, for example.

A transfer cylinder 3 is mounted above the conveyor belt 1 and the sheets 2, respectively, so as to be rotatable about an axis 4. An impression cylinder 5 is rotatably mounted or journalled below the conveyor belt 1. The transfer cylinder 3 and the impression cylinder 5 extend axially across the printing width or breadth of the sheets 2. The transfer cylinder 3 and the impression cylinder 5 are in pressing engagement with one another, so that the sheets 2, when conveyed by the conveyor belt 1 through a nip between the transfer cylinder 3 and the transfer cylinder 5, are pressed against the impression cylinder 3. The conveyor belt 1 has an insulating surface which is electrically charged by a device 12, so that the sheets 2 adhere to the conveyor belt 1 electrostatically while they are being transported. Alternatively or additionally, the sheets 2 may be suitably electrically charged.

Image data are transmitted to a diagrammatically illustrated imaging head 6 arranged at a given location at the circumference of the transfer cylinder 3, and the imaging head 6 produces latent images on the transfer cylinder 3 based upon the image data, for example, in the form of charge distributions corresponding with the desired printing images. The latent images are developed in accordance with the charge distribution by an inking unit 7 diagrammatically illustrated in the drawings, printing ink being selectively applied to the transfer cylinder 3 or 2 revolving belt 11, and the developed images being then transferred to the sheets 2 by more or less heavy pressure and fixed on the sheets by suitable conventional means which are not shown in the drawings.

When a leading edge of a sheet 8 exits from the nip between the transfer cylinder 3 and the impression cylinder 5, there exists a danger that the leading edge of the sheet 8 will separate from the conveyor belt 1 in spite of the electrostatic holding force and will continue to adhere, as represented by the dotted lines in FIG. 1, to the transfer cylinder 3.

Figure 2:
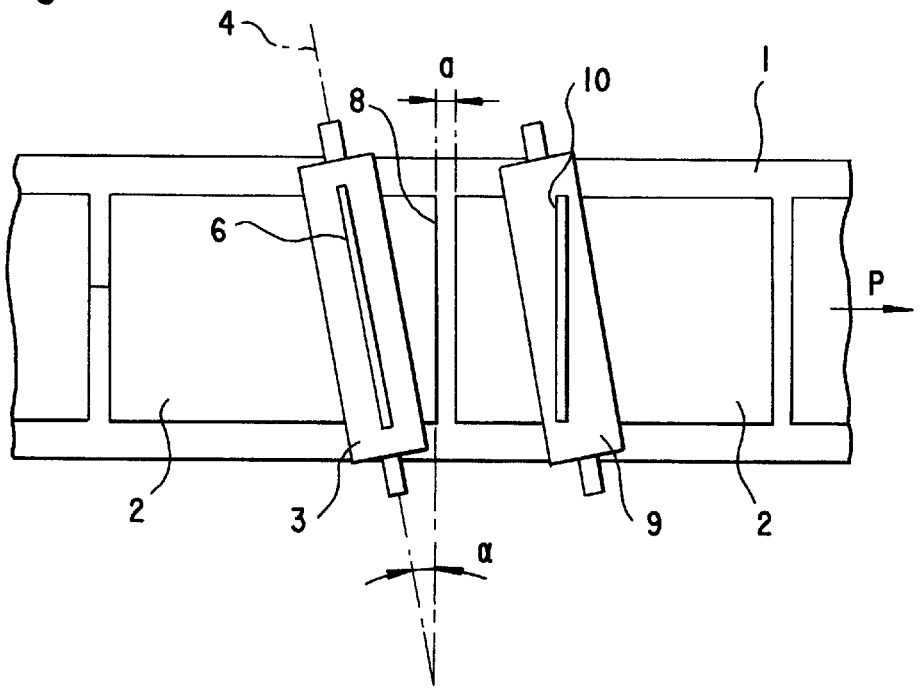
FIG. 2 is a reduced top plan view of FIG. 1 showing two of the transfer cylinders of the digital printing machine.

This is prevented by not mounting the transfer cylinder 3 and, accordingly, the impression cylinder 5 in the printing machine perpendicularly to the transport direction P, but rather, by mounting them skewed or inclined to the transport direction p, as shown in FIG. 2. Because the sheets lie on the conveyor belt 1 rectangularly, i.e., with the respective leading edge 8 thereof disposed perpendicularly to the transport direction P, the axis 4 of the transfer cylinder 3 intercepts a small angle $\alpha$ with the respective leading edge 8 of the sheets 2. Although an angle $\alpha$ of approximately 10° is shown in FIG. 2 for illustrative purposes, the actual angle may be considerably smaller in practice. For determining the size of the angle $\alpha$ it is essential that, whenever a sheet enters into the nip between the transfer cylinder 3 and the impression cylinder 5, always only a small portion of the leading edge 8 thereof is present in the nip. In order to achieve this, an angle $\alpha$ of 10° or less may be sufficient in a given machine configuration with a nip width of, for example, 0.5 mm to 1 mm.

By skewing the transfer cylinder 3, the sheets 2 leaving the nip tend to separate less readily from the conveyor belt 1. Additionally, impacts or shocks at the entry of the sheets 2 into and exit of the sheets 2 from the nip are avoided. Such shocks are very reliably prevented when the spacing between successive sheets 2 is small, so that at any instant of time there is at least one sheet 2 in the nip.

The imaging head 6 which includes, for example, a longitudinal array of image-producing elements extending across the printable width of the sheet, may be arranged in parallel with the axis 4 of the transfer cylinder 3. In this case, the image data transmitted to the imaging head 6 must be changed or influenced so as to comply with the skewed position of the transfer cylinder 3. With an imaging head 6 having an array of image-producing elements with a pixel-spacing therebetween, the data belonging to the image-producing elements located along the circumference of the transfer cylinder 3 close to the sheet 2 may, for example, be transmitted to the imaging head 6 with a suitable delay. Furthermore, there are other possible ways of taking into account the skewed position of the transfer cylinder 3, for example, by angular transformation of an electronically stored printing original, by "skewed" sensing and reading of a printing original and the like.

Furthermore, the change of the pixel-space and printing width, respectively, due to skewing will have to be taken into consideration, if this does not appear to be negligible, due to a relatively small angle $\alpha$.

Just like the transfer cylinder 3, any further transfer cylinders required for additional colors may be placed into a skewed or inclined position.

The imaging heads may also be arranged in parallel with the leading edge 8 of the sheet 2, as illustrated in FIG. 2, wherein an imaging head 10 is shown on a further transfer cylinder 9. In this case, there is no change of the pixel spacing and the printing width, respectively, and the image data can be transmitted to the imaging head 10 line by line without change, so that the information is processed in exactly the same manner as in the case of a perpendicularly positioned transfer cylinder. If the angle $\alpha$ is small and the imaging head 10 is of a type which does not need to be positioned at a precisely defined distance from the transfer cylinder 9, the imaging head 10 does not have to be especially adapted to a skewed position. Otherwise, imaging-head constructions are also conceivable which, so to speak, "cling" or "conform" to the transfer cylinder 9.

In both of the aforementioned cases, the inking unit 7 may be arranged in a conventional manner, i.e., in parallel with the axis of the transfer cylinders 3 and 9, respectively.

Instead of printing units with, respectively, only one transfer cylinder 3 or 9, as shown in FIGS. 1 and 2, printing units with a plurality of transfer cylinders arranged behind one another or in tandem may be used, for example, with a cylinder having the imaging head and the inking unit arranged at the outer circumferential surface thereof, and with a further cylinder in rolling-off engagement with the cylinder associated with the imaging head and the inking unit, the further cylinder, in turn, rolling-off on the sheets and the conveyor belt, respectively.

Furthermore, in place of the transfer cylinders 3 or 9, a belt 11 which revolves around two or more cylinders may also be used, with the printing images being produced on the surface of the belt 11 or being transferred onto the surface of the belt by a cylinder or belt arranged in front thereof and then being transferred from the surface of the belt onto the sheets. In this case, the cylinder transferring the printing ink from the belt 11 to the sheets is arranged above the conveyor belt in the manner shown in FIG. 2. The imaging head may thereby be advantageously arranged at a rectilinearly extending section of the belt in a manner that the latent images can be produced without any adaptation of the image data, and then true-to-the-original, undistorted images may be printed on the sheets.

In an alternative embodiment of the invention of the instant application which is not illustrated in detail, the transfer cylinders are arranged so as to be perpendicular to the transport direction P, and the feeder of the printing machine is constructed in a such a manner that the sheets are conveyed on the conveyor belt in a skewed or inclined position, with the longitudinal edges thereof extending at a small angle to the transport direction P. In this case, too, both options described in connection with FIG. 2 are provided, i.e. the arrangement of the imaging heads either in parallel with the leading edge of the sheet or perpendicularly to the transport direction, and suitably controlling the imaging heads, respectively.

I claim:

1. A digital printing machine including an endless conveyer belt having an elongated section whereon substrates to be printed are successively transported through the printing machine in a transport direction, and comprising at least one printing unit having a cylinder arranged opposite the elongated section of the conveyor belt and the substrates conveyed thereon, respectively, said cylinder having an axis extending transversely to the transport direction and being rotatable in synchronism with the transporting movement of the conveyor belt, so as to transfer printing ink to the substrates in accordance with a distribution corresponding with a desired printing image, said cylinder being disposed so that an angle defined between said cylinder axis and the transport direction has a value differing from 90°.

2. The digital printing machine according to claim 1, including a belt revolving around said printing cylinder, and wherein the printing ink to be transferred is located on a surface of said belt revolving around said cylinder.

3. The digital printing machine according to claim 2, including an elongated imaging device arranged transverse to the transport direction alongside said surface of said one of said cylinder and said belt revolving around said cylinder, said imaging device being controllable by electrical signals for producing latent images on said surface in accordance with said electrical signals, said printing unit including an inking unit for developing said latent images with printing ink.

4. The digital printing machine according to claim 3, wherein said imaging device is disposed at an angle of 90° to the transport direction.

5. The digital printing machine according to claim 3, wherein said imaging device is disposed parallel to said axis of said cylinder.

6. The digital printing machine according to claim 1, including a device for generating attracting forces between the conveyer belt and the substrates transported thereby.

7. The digital printing machine according to claim 6, wherein said attracting forces are electrostatic forces.

8. The digital printing machine according to claim 1, wherein said at least one printing unit has a plurality of cylinders arranged opposite the elongated section of the conveyor belt and the substrates conveyed thereon, respectively, said cylinders having respective axes extending transversely to the transport direction and being rotatable in synchronism with the transporting movement of the conveyor belt, so as to transfer printing ink to the substrates in accordance with distribution corresponding with a desired printing image, said cylinders being disposed so that an angle defined between said cylinder axes, respectively, and the transport direction has a value differing from 90°.

9. The digital printing machine according to claim 1, wherein the printing ink to be transferred is located on a surface of said cylinder.

* * * * *